US007837196B2

(12) United States Patent
Iguchi et al.

(10) Patent No.: US 7,837,196 B2
(45) Date of Patent: Nov. 23, 2010

(54) CONNECTION APPARATUS FOR CONNECTING IMAGE FORMING APPARATUS AND SHEET POST-PROCESSING APPARATUS

(75) Inventors: Ken Iguchi, Shizuoka-ken (JP); Isao Yahata, Shizuoka-ken (JP); Toshiaki Oshiro, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 284 days.

(21) Appl. No.: 12/058,391

(22) Filed: Mar. 28, 2008

(65) Prior Publication Data

US 2009/0057991 A1 Mar. 5, 2009

Related U.S. Application Data

(60) Provisional application No. 60/968,850, filed on Aug. 29, 2007, provisional application No. 60/968,854, filed on Aug. 29, 2007, provisional application No. 60/969,146, filed on Aug. 30, 2007.

(51) Int. Cl.
*B65H 39/10* (2006.01)

(52) U.S. Cl. ..... 271/298; 271/303

(58) Field of Classification Search ..... 271/303, 271/298; 270/58.07, 58.09, 58.14
See application file for complete search history.

(56) References Cited

U.S. PATENT DOCUMENTS

| | | | | |
|---|---|---|---|---|
| 6,494,453 | B1 * | 12/2002 | Yamada et al. | 271/288 |
| 6,955,351 | B2 | 10/2005 | Sueoka et al. | |
| 7,140,611 | B2 * | 11/2006 | Fujii et al. | 271/298 |

FOREIGN PATENT DOCUMENTS

| | | |
|---|---|---|
| JP | 3-98931 | 4/1991 |
| JP | 9-132346 | 5/1997 |
| JP | 10-291708 | 11/1998 |
| JP | 2001-233541 | 8/2001 |
| JP | 2003-146480 | 5/2003 |
| JP | 2003-289422 | 7/2004 |
| JP | 2006-111382 | 4/2006 |
| JP | 2007-70100 | 3/2007 |

* cited by examiner

*Primary Examiner*—David H Bollinger
(74) *Attorney, Agent, or Firm*—Patterson & Sheridan, LLP

(57) ABSTRACT

There is provided a connection apparatus for connecting an image forming apparatus and a plurality of sheet post-processing apparatuses. This connection apparatus has a flapper portion for switching a plurality of conveying paths going toward the plurality of sheet post-processing apparatuses. Sensors are provided near inlet rollers and near output rollers, respectively. Outputs of the sensors are inputted to a wired OR circuit, so that an output of the wired OR circuit is supplied to a CPU of one of the connected sheet post-processing apparatuses.

17 Claims, 10 Drawing Sheets

CONNECTION APPARATUS FOR CONNECTING IMAGE FORMING APPARATUS AND SHEET POST-PROCESSING APPARATUS

CROSS-REFERENCE TO RELATED APPLICATIONS

This application is based upon and claims the benefit of priority from the prior U.S.A. Patent Application No. 60/968,850, filed on 29 Aug., 2007, the prior U.S.A. Patent Application No. 60/968,854, filed on 29 Aug., 2007, and the prior U.S.A. Patent Application No. 60/969,146, filed on 30 Aug., 2007, the entire contents of which are incorporated herein by reference.

BACKGROUND OF THE INVENTION

1. Field of the Invention

The present invention relates to a connection apparatus for connecting an image forming apparatus such as a copier and at least one sheet post-processing apparatus disposed in the image forming apparatus. Particularly, it relates to a connection apparatus provided with a mechanism for distributing sheets of paper with images formed thereon into a plurality of sheet post-processing apparatuses.

2. Description of the Related Art

A sheet post-processing apparatus for performing post-processing such as sorting, stapling, etc. of sheets of paper with images formed thereon is sometimes used in an image forming apparatus such as a copier. This sheet post-processing apparatus stacks sheets of paper received from the image forming apparatus on a processing tray, staples the sheets of paper and discharges the sheets of paper to a paper discharge tray.

Since there are various kinds of image forming apparatuses, the position of a paper discharge port for discharging sheets of paper with images formed thereon varies in accordance with the kind. Such a sheet post-processing apparatus was hitherto designed and manufactured in accordance with the kind. For this reason, there was a problem that the manufacturing cost of such a sheet post-processing apparatus became high.

With respect to this point, there has been proposed a connection apparatus in which a paper acceptance port of a paper guide plate is widened while a paper discharge port is narrowed to be connected to a sheet post-processing apparatus (e.g. JP-A-2001-233541).

There has been also proposed a connection apparatus having a position adjusting mechanism for tilting the connection apparatus or slightly shifting the installation location of the connection apparatus (e.g. JP-A-10-291708).

These techniques however had a problem that sheets of paper with images formed thereon could not be distributed to a plurality of different sheet post-processing apparatuses.

There was also a problem that a simple method of providing conveying paths for distributing sheets of paper with images formed thereon into different sheet post-processing apparatuses could not control the timing of paper discharge appropriately to deliver the sheets of paper to these sheet post-processing apparatuses.

BRIEF SUMMARY OF THE INVENTION

It is an object of the present invention to provide a connection apparatus in which sheets of paper with images formed thereon can be distributed to different sheet post-processing apparatuses.

In an aspect of the present invention, the connection apparatus includes: inlet rollers for accepting a sheet of paper with an image formed thereon from an image forming apparatus; an inlet paper sensor provided in a position substantially the same as that of the inlet rollers with respect to a paper conveying direction; a flapper portion provided on a downstream side of the inlet paper sensor with respect to the paper conveying direction and for switching a first sheet conveying path for conveying the sheet of paper to a first sheet post-processing apparatus to a second sheet conveying path having a longer paper conveying distance than that of the first sheet conveying path, for conveying the sheet of paper to a second sheet post-processing apparatus, and vice versa; outlet rollers provided on the second sheet conveying path and on a downstream side of the flapper portion with respect to the paper conveying direction; and an outlet paper sensor provided in a position substantially the same as that of the outlet rollers with respect to the paper conveying direction. Further, one side in which the sheet conveying paths are formed is divided into two parts so that each of the two parts is formed so as to be able to be pivoted.

DETAILED DESCRIPTION OF THE INVENTION

Throughout this description, the embodiments and examples shown should be considered as exemplars, rather than limitations on the apparatus and methods of the present invention.

An embodiment of the invention as to an apparatus for post-processing sheets of paper with images formed thereon (hereinafter referred to as sheet post-processing apparatus) will be hereinafter described in detail with reference to the drawings. In the respective drawings, like numerals refer to like parts so that duplicated description of the parts will be omitted.

(Sheet Post-Processing System Using Connection Apparatus)

Figure 1:
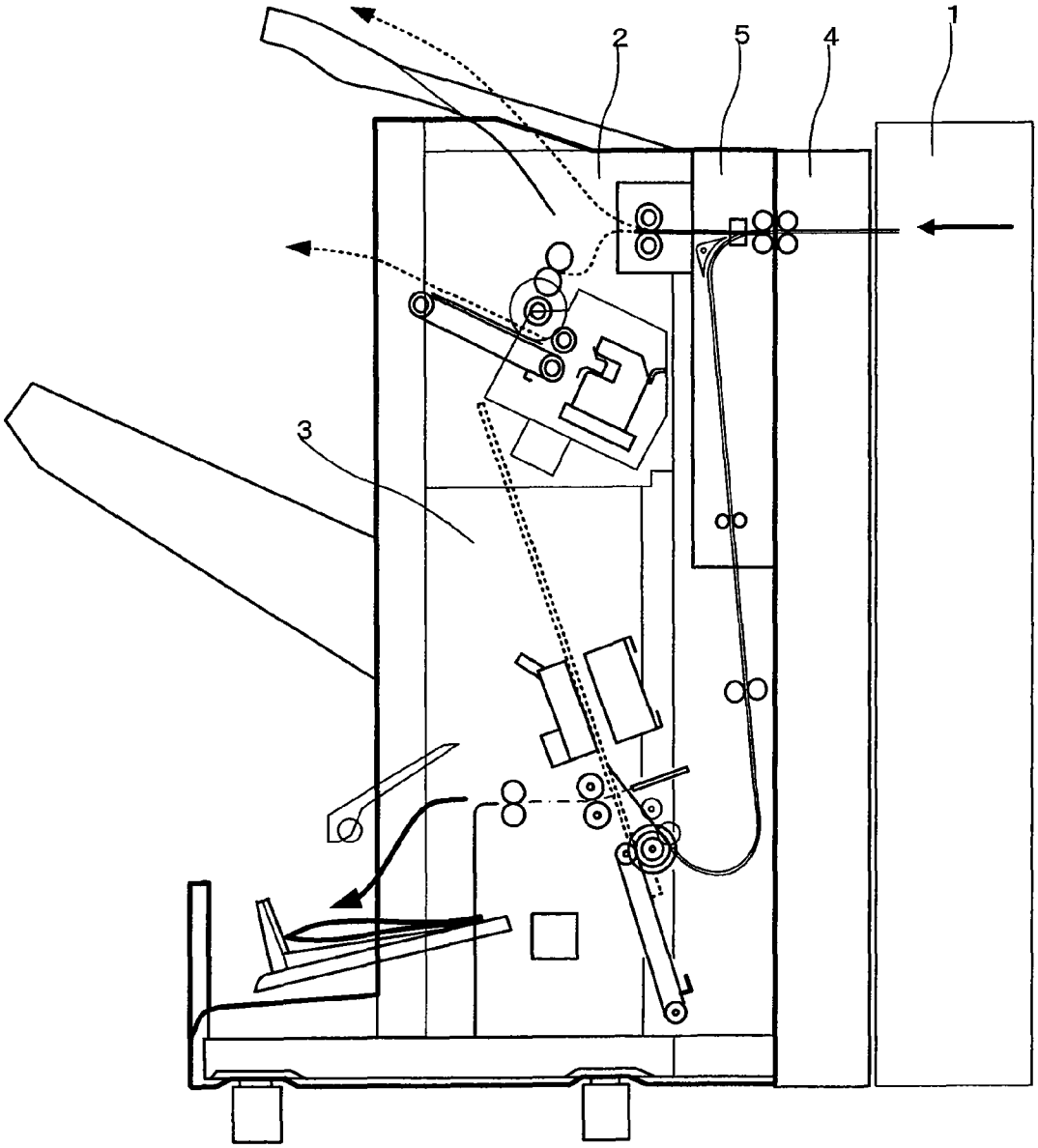
FIG. 1 is a sectional view showing a state in which a connection apparatus 5 according to an embodiment of the invention is used.

FIG. 1 is a sectional view showing a state where a connection apparatus 5 according to the embodiment is used. As shown in FIG. 1, the connection apparatus 5 is connected to a punch unit 4 whose paper inlet side is disposed on an image forming apparatus 1. In a system having no punch unit 4 connected, the paper inlet side of the connection apparatus 5 may be connected directly to the image forming apparatus 1.

Further, a paper outlet side of the connection apparatus 5 is connected to a plurality of sheet post-processing apparatuses. For example, as shown in FIG. 1, the paper outlet side of the connection apparatus 5 is connected to a finisher 2 and a saddle device 3. The finisher 2 performs stapling or sorting whereas the saddle device 3 makes a booklet by stapling and folding a stack of sheets of paper.

Incidentally, sheet post-processing apparatuses to be connected are not limited to the aforementioned ones.

(Summary of Connection Apparatus)

Figure 2:
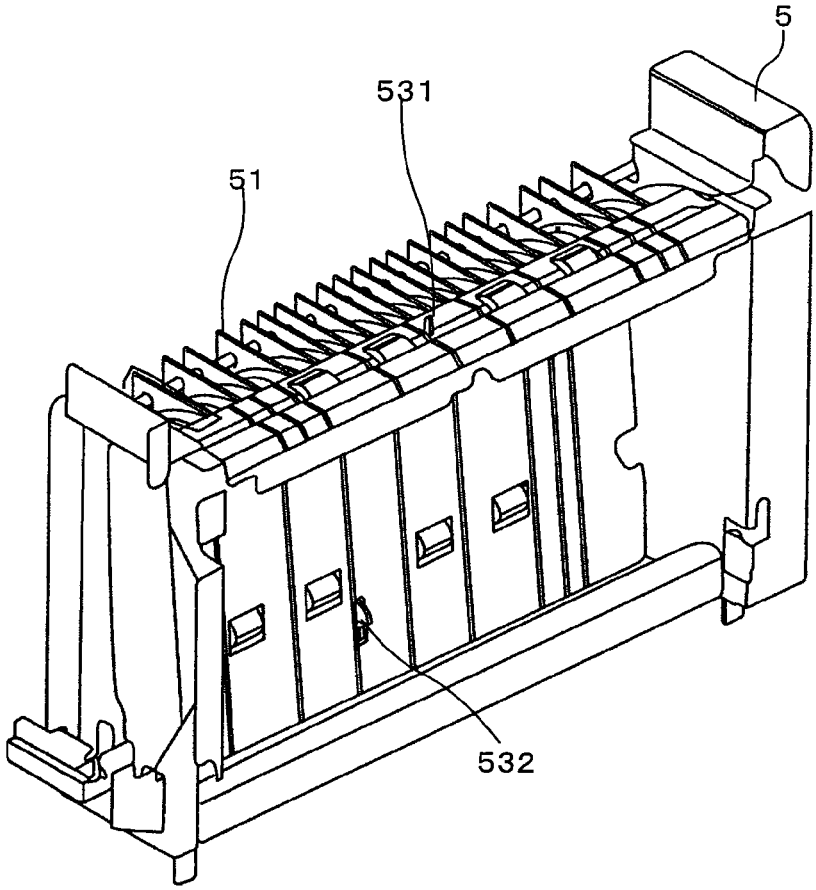
FIG. 2 is a perspective view of the external appearance of the connection apparatus 5.
Figure 3:
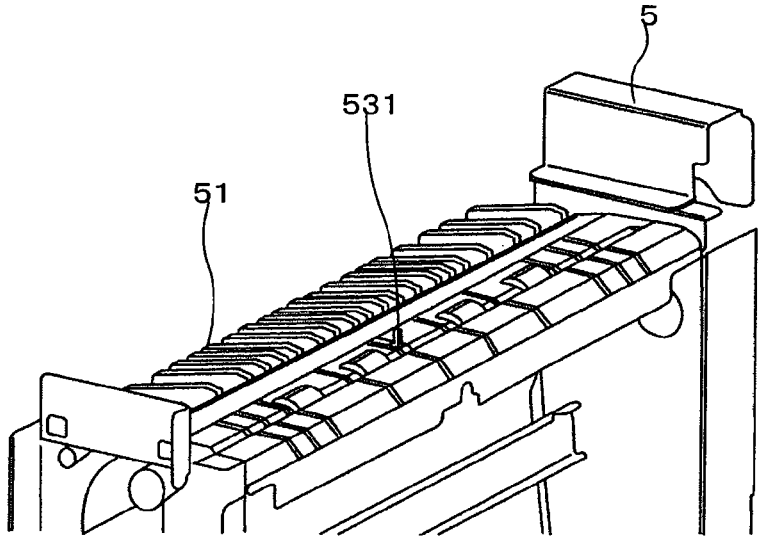
FIG. 3 is a perspective view of the external appearance of a flapper portion of the connection apparatus 5.

FIG. 2 is a perspective view of the external appearance of the connection apparatus 5. FIG. 3 is a perspective view of the external appearance of a flapper portion of the connection apparatus 5.

The connection apparatus 5 has: a flapper portion 51 for switching a paper conveying direction; an inlet paper sensor 531 disposed in an inlet of a sheet conveying path leading into the connection apparatus 5; and an outlet paper sensor 532 disposed in an outlet of the sheet conveying path of the connection apparatus 5.

The flapper portion 51 is driven to move up and down by a solenoid (not shown). When the connection apparatus 5 carries a sheet of paper to the finisher 2, the flapper portion 51 is moved down as shown in FIG. 2. In the connection apparatus 5, the sheet of paper is passed over the flapper portion 51 so as to be carried to the finisher 2.

When the connection apparatus 5 carries a sheet of paper to the saddle device 3, the flapper portion 51 is moved up as shown in FIG. 3. In the connection apparatus 5, the sheet of paper is passed under the flapper portion 51 so as to be carried to the saddle device 3.

In the connection apparatus 5, each of the inlet paper sensor 531 and the outlet paper sensor 532 is provided in a position where a sheet of paper with a minimum width passing through the connection apparatus 5 can be detected but punch holes in the sheet of paper cannot be detected.

When, for example, the connection apparatus is designed so that a sheet of paper passes through the center of the sheet conveying path of the connection apparatus, each of the inlet paper sensor 531 and the outlet paper sensor 532 in the connection apparatus 5 is provided in a position shifted from the widthwise center of the conveying path by a distance obtained as the sum of the radius of each punch hole and a displacement quantity of the sheet conveying path.

(Kind of Connection Apparatus)

Figure 4:
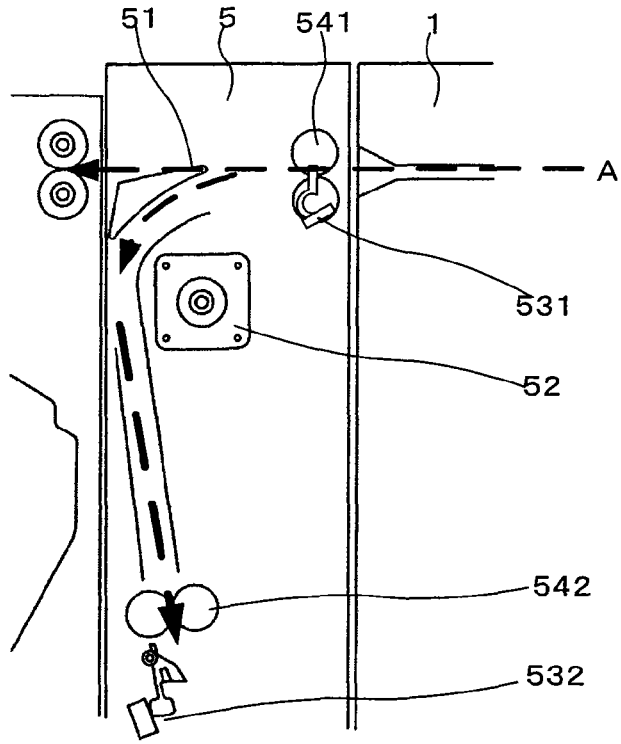
FIG. 4 is a sectional view showing the connection apparatus 5 in which an inlet of a sheet conveying path is located in an upper portion.

FIG. 4 is a sectional view showing the connection apparatus 5 in which the inlet of the sheet conveying path is located in an upper portion. When the flapper portion 51 is moved down, the sheet conveying path is switched to a first sheet conveying path which is substantially horizontal, so that the connection apparatus 5 carries a sheet of paper to the finisher 2 along the first sheet conveying path. When the flapper portion 51 is moved up, the sheet conveying path is switched to a second sheet conveying path going downward, so that the connection apparatus 5 carries a sheet of paper to the saddle device 3 along the second sheet conveying path.

In the connection apparatus 5, the inlet paper sensor 531 is provided on an upstream side of the flapper portion 51 with respect to the paper conveying direction. In the connection apparatus 5, the inlet paper sensor 531 is used in common with the first sheet conveying path and the second sheet conveying path.

In the connection apparatus 5, it is desirable that the inlet paper sensor 531 is provided in a range where the first and second sheet conveying paths overlap inlet rollers 541 with respect to the paper conveying direction. In the embodiment of the invention, the inlet paper sensor 531 is disposed in a position substantially coincident with or close to a nip position between the inlet rollers 541. In the connection apparatus 5, the provision of the inlet paper sensor 531 in this position permits detection of incoming of paper and control of the operation of the inlet rollers 541 to be interlocked with each other more accurately.

In the connection apparatus 5, the outlet paper sensor 532 is provided on a downstream side (with respect to the paper conveying direction) of output rollers 542 located near the outlet of the sheet conveying path. In the connection apparatus 5, the provision of the outlet paper sensor 532 in this position permits detection of discharge of paper from the connection apparatus 5 and more accurate control of the operation of the outlet rollers 542 to be interlocked with each other.

The distance from the inlet paper sensor 531 to the outlet paper sensor 532 is smaller than the length (with respect to the paper conveying direction) of a minimum-size sheet of paper to be processed in the saddle device 3. When, for example, the minimum-size sheet of paper to be processed in the saddle device 3 is LT-R, the length of the sheet of paper with respect to the paper conveying direction is 279 mm. Accordingly, the spacing distance from the inlet paper sensor 531 to the outlet paper sensor 532 may be set, for example, to be not smaller than 245 mm and not larger than 277 mm. That is, the spacing distance between the inlet paper sensor 531 and the outlet paper sensor 532 may be set to be smaller than the length (with respect to the conveying direction) of the minimum-size sheet of paper allowed to be processed by a second sheet post-processing apparatus provided so as to be connected to the second sheet conveying path.

Figure 5:
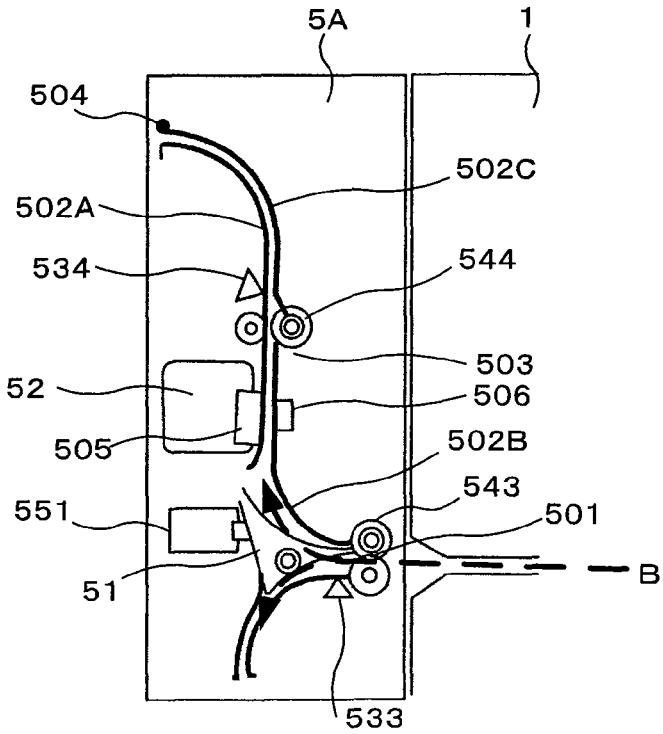
FIG. 5 is a sectional view showing a connection apparatus 5A in which an inlet of a sheet conveying path is located in a lower portion.

FIG. 5 is a sectional view showing a connection apparatus 5A in which the inlet of the sheet conveying path is located in a lower portion. When the flapper portion 51 is moved down by the operation of a solenoid 551, the sheet conveying path is switched to a first sheet conveying path going upward, so that the connection apparatus 5A carries a sheet of paper to the finisher 2 along this first sheet conveying path. When the flapper portion 51 is moved up, the sheet conveying path is switched to a second sheet conveying path going downward, so that the connection apparatus 5A carries a sheet of paper to the saddle device 3 along the second sheet conveying path.

The connection apparatus 5A has an inlet paper sensor 533 provided on an upstream side of the flapper portion 51 with respect to the paper conveying direction. In the connection apparatus 5A, the inlet paper sensor 533 is used in common with the first sheet conveying path and the second sheet conveying path.

In the connection apparatus 5A, it is desirable that the inlet paper sensor 533 is provided in a range where the first and second sheet conveying paths overlap inlet rollers 543 with respect to the paper conveying direction. In the embodiment of the invention, the inlet paper sensor 533 is disposed close to a nip position between the inlet rollers 543. In the connection apparatus 5A, the provision of the inlet paper sensor 533 in this position permits detection of incoming of paper and control of the operation of the inlet rollers 543 to be interlocked with each other more accurately.

The connection apparatus 5A has an outlet paper sensor 534 provided on a downstream side (with respect to the paper conveying direction) of outlet rollers 544 located in the middle of the sheet conveying path. In the connection apparatus 5A, the provision of the outlet paper sensor 534 in this position permits detection of discharge of paper from the connection apparatus 5A and control of the operation of the outlet rollers 544 to be interlocked with each other more accurately.

The spacing distance from the inlet paper sensor 533 to the outlet paper sensor 534 is smaller than the length (with respect to the paper conveying direction) of a minimum-size sheet of paper to be processed in the finisher 2. When, for example, the minimum-size sheet of paper to be processed in the finisher 2 is a post card, the length of this sheet of paper with respect to the paper conveying direction is 140 mm. Accordingly, the spacing distance from the inlet paper sensor 533 to the outlet paper sensor 534 may be set, for example, to be not smaller than 120 mm and not larger than 138 mm.

(Control of Flapper Portion)

In the connection apparatus 5 (hereinafter inclusive of the connection apparatus 5A except the case pointed out particularly), the flapper portion 51 is set so as to form the first sheet conveying path which goes toward the finisher 2 and which is used frequently. When a saddle stitching process (booklet-making job) is designated, the solenoid (not shown) in the connection apparatus 5 is controlled to switch the flapper portion 51 so as to form the second sheet conveying path going toward the saddle device 3.

A CPU in the saddle device 3 controls the solenoid because a sheet of paper is carried to the saddle device 3 and processed in the saddle device 3 when the solenoid is driven to switch the flapper portion 51.

Besides a general solenoid, a latching solenoid can be used as the solenoid. When a latching solenoid is used, the solenoid is controlled by a CPU in the finisher 2 or the CPU in the saddle device 3. In order to simplify wiring, it is desirable that the CPU of the finisher 2 controls the latching solenoid.

(Driving Method of Connection Apparatus)

Some image forming apparatus 1 has a one-way clutch in paper discharge rollers disposed in the outlet of the sheet conveying path, and some image forming apparatus 1 has no one-way clutch.

A problem such as paper jamming does not occur in the image forming apparatus 1 having the one-way clutch, even when the speed of paper reception in the finisher 2 is different from the speed of paper discharge in the image forming apparatus 1.

For this reason, controlling is simplified when the connection apparatus 5 is configured so that a conveying motor pulse signal for driving a stepping motor of the finisher 2 is inputted into the connection apparatus 5 to thereby drive a stepping motor 52 of the connection apparatus 5.

On the other hand, when the connection apparatus 5 is connected to the image forming apparatus 1 having no one-way clutch, it is necessary to synchronize the paper discharge speed of the image forming apparatus 1 with the paper suction speed of the finisher 2. When the connection apparatus 5 is connected to a high-speed image forming apparatus 1, the finisher 2 accelerates the conveying speed. For this reason, the connection apparatus 5 is provided with a paper conveying motor 52 controlled by the CPU of the connection apparatus 5 to thereby adjust the paper conveying speed.

(Mounting Method of Connection Apparatus)

Figure 6:
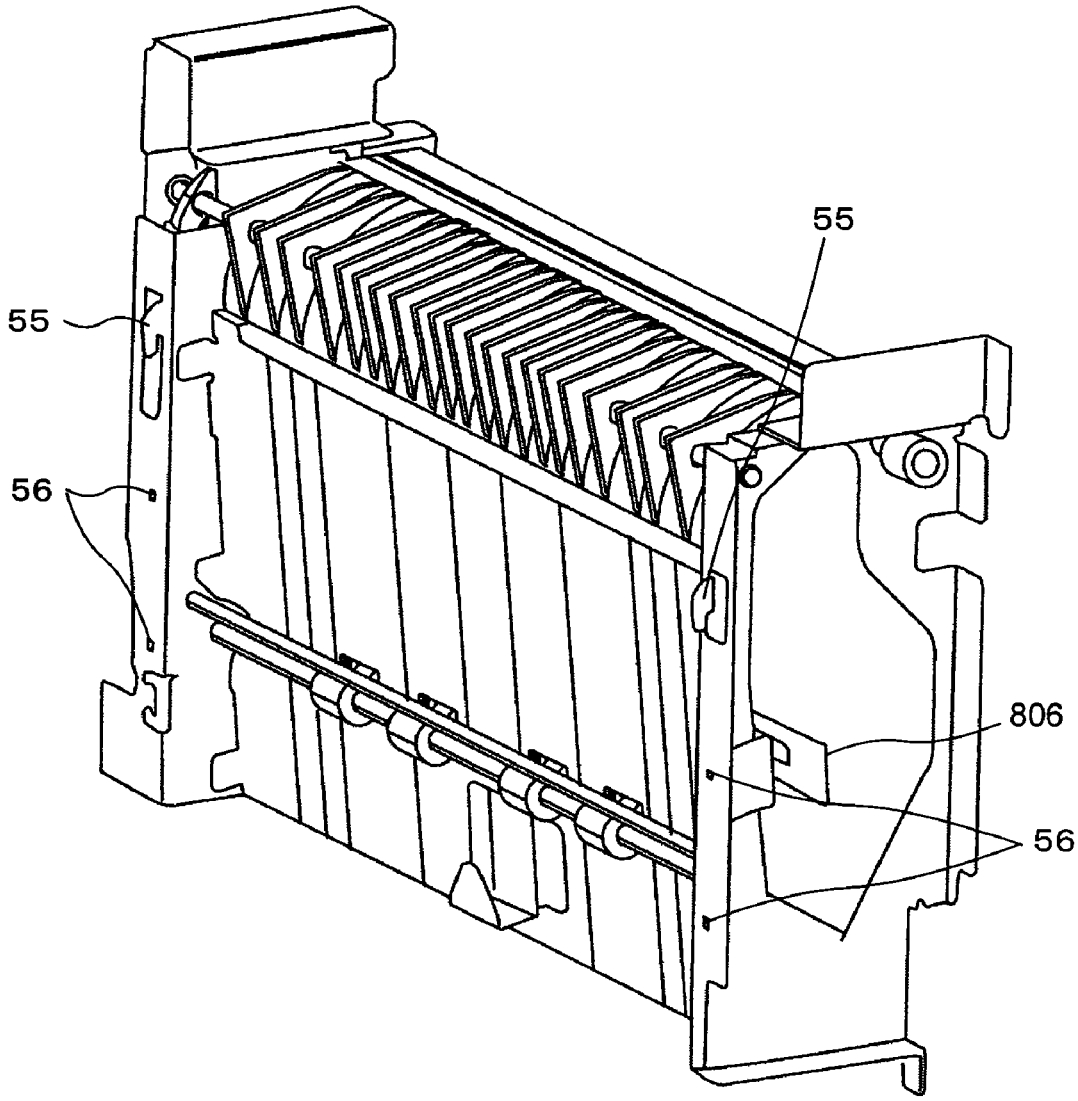
FIG. 6 is a view showing a mounting mechanism of the connection apparatus 5.

FIG. 6 is a view showing a mechanism of mounting the connection apparatus 5. Mounting brackets of a third sheet post-processing apparatus such as a punch unit 4 which can be mounted between the image forming apparatus 1 and the connection apparatus 5 are the same in shape as mounting brackets of the connection apparatus 5.

As shown in FIG. 6, the connection apparatus 5 has mounting brackets 55 in left and right connection surfaces to be connected to the finisher 2. The connection apparatus 5 is connected to the finisher 2 in such a manner that the mounting brackets 55 are hooked on the finisher 2. Then, the finisher 2 is screwed in four thread holes 56.

The punch unit 4 has the mounting brackets 55 in the same shape. When the connection apparatus 5 is not connected to the saddle device 3 but connected to an image forming apparatus 1 having a paper discharge outlet at the same height as the paper suction port of the finisher 2, the finisher 2 can be connected to the punch unit 4 directly without connection of the connection apparatus 5.

(Connection of Each Sensor)

Sheets of paper with images formed thereon are discharged from the image forming apparatus 1 at regular intervals. On the other hand, the saddle device 3 needs to widen the conveying interval between a sheet of paper and a sheet of paper in order to perform a matching process. For this reason, upon reception of sheets of paper, the saddle device 3 accelerates the conveying speed to widen the interval between a sheet of paper and a sheet of paper.

Figure 7:
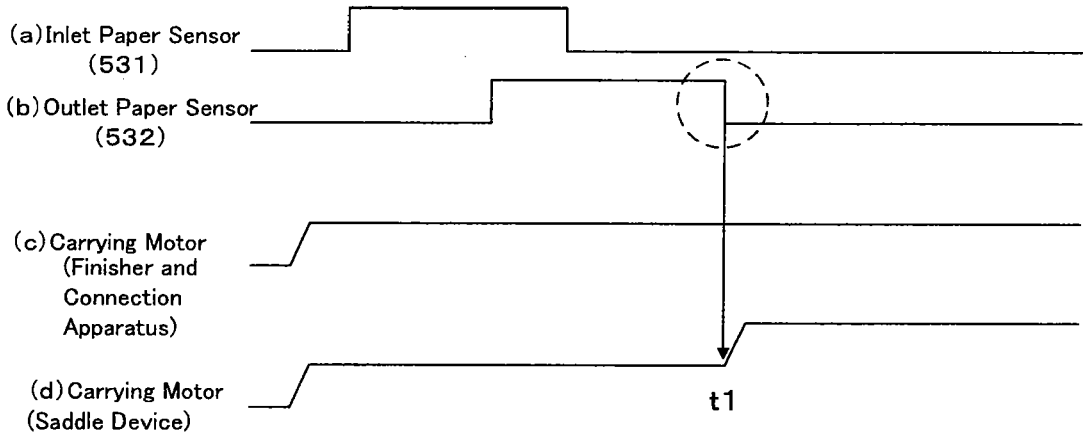
FIG. 7 is a timing chart for respective sensors in the connection apparatus 5 shown in FIG. 4 and a conveying motor in a saddle device 3.

FIG. 7 is a timing chart for the respective sensors in the connection apparatus 5 shown in FIG. 4 and the conveying motor in the saddle device 3. In FIG. 7, (a) represents an output of the inlet paper sensor 531, (b) represents an output of the outlet paper sensor 532, (c) represents the speed of the conveying motor in the finisher 2 and the connection apparatus 5 shown in FIG. 4, and (d) represents the speed of the conveying motor in the saddle device 3.

When the connection apparatus 5 shown in FIG. 4 is connected to the saddle device 3, turning off of the outlet paper sensor 532 means that a sheet of paper has passed through the connection apparatus 5. Therefore, as shown in the timing chart of FIG. 7, the saddle device 3 accelerates the conveying motor of the saddle device 3 at time t1 when the saddle device 3 detects turning off of the outlet paper sensor 532.

Figure 8:
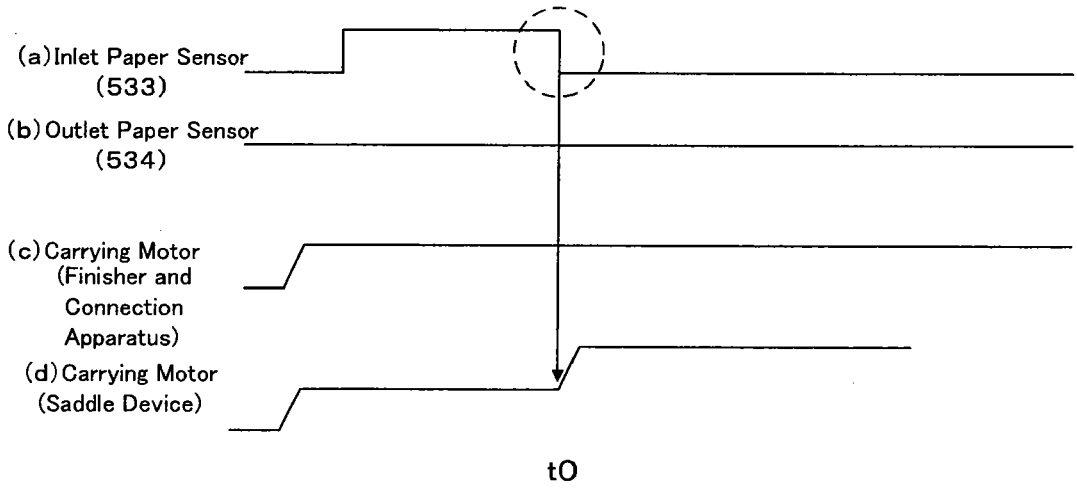
FIG. 8 is a timing chart for respective sensors in a connection apparatus 5A and a conveying motor in a saddle device 3.

FIG. 8 is a timing chart for the respective sensors in the connection apparatus 5A and the conveying motor in the saddle device 3. In FIG. 8, (a) represents an output of the inlet paper sensor 533, (b) represents an output of the outlet paper sensor 534, (c) represents the speed of the conveying motor in the finisher 2 and the connection apparatus 5A, and (d) represents the speed of the conveying motor (not shown) in the saddle device 3.

When the connection apparatus 5A is connected to the saddle device 3, sheets of paper do not go through the outlet paper sensor 534. Accordingly, turning off of the inlet paper sensor 533 means that a sheet of paper has passed through the connection apparatus 5A. Therefore, as shown in the timing chart of FIG. 8, the saddle device 3 accelerates the conveying motor of the saddle device 3 at time t0 when the saddle device 3 detects turning off of the inlet paper sensor 533.

Assuming that a control portion of the saddle device 3 performs this control, then the configuration and control of apparatuses are complicated because the saddle device 3 must have a mechanism for identifying kinds of connection apparatuses 5 connected to the saddle device 3.

In order to solve this problem, each sensor in this embodiment is connected as follows.

Figure 9:
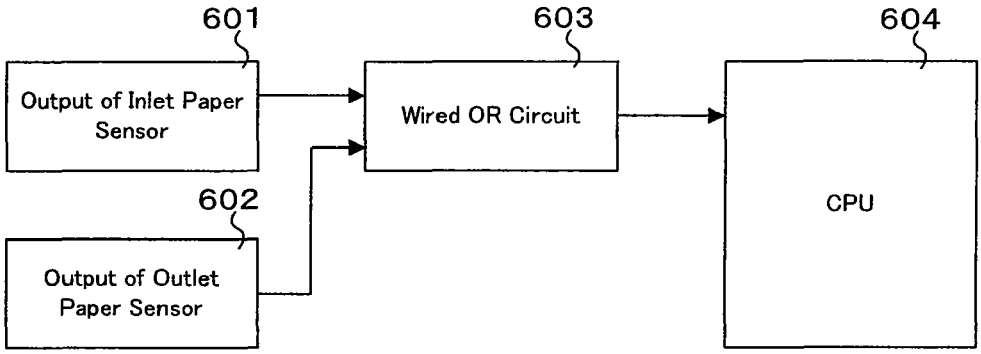
FIG. 9 is a block diagram showing connection between an inlet paper sensor 531 or 533 and an outlet paper sensor 532 or 534.

FIG. 9 is a block diagram showing connection between the inlet paper sensor 531 or 533 and the outlet paper sensor 532 or 534. As shown in FIG. 9, in the connection apparatus 5, an output 601 of the inlet paper sensor and an output 602 of the outlet paper sensor are connected to a wired OR circuit 603, and an output of the wired OR circuit 603 is supplied to a CPU 604 of the saddle device 3.

Figure 10:
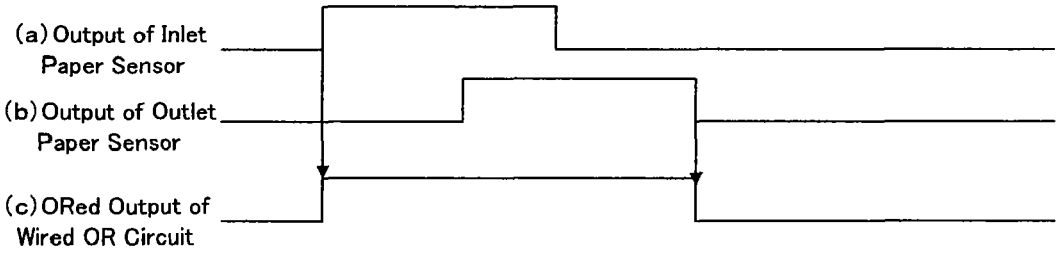
FIG. 10 is a timing chart showing an output of a wired OR circuit 603.

FIG. 10 is a timing chart showing the output of the wired OR circuit 603. In FIG. 10, (a) represents the output 601 of the inlet paper sensor 531 or 533, (b) represents the output 602 of the outlet paper sensor 532 or 534, and (c) represents the output of the wired OR circuit 603.

As shown in FIG. 10, the wired OR circuit 603 outputs "on" when both or either of the output 601 of the inlet paper sensor and the output 602 of the outlet paper sensor is "on", whereas the wired OR circuit 603 outputs "off" when both of the output 601 of the inlet paper sensor and the output 602 of the outlet paper sensor are "off".

Figure 11:
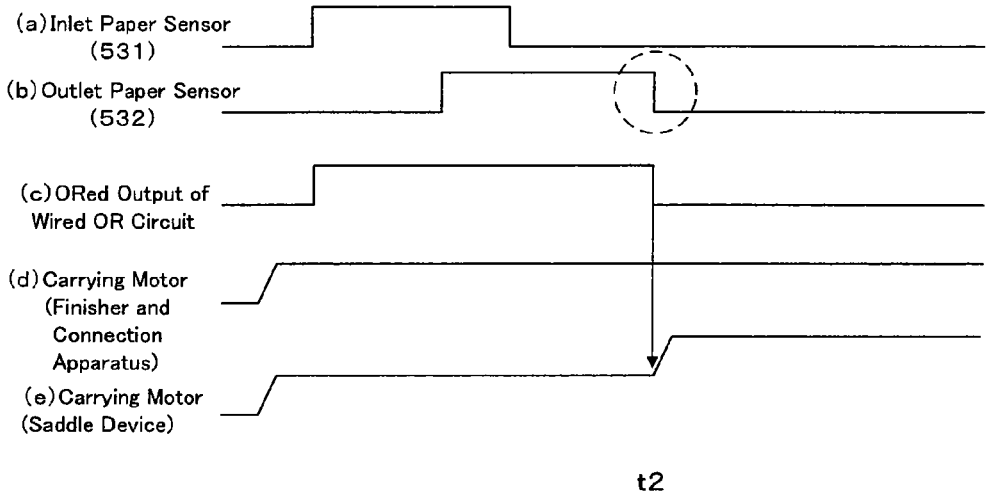
FIG. 11 is a timing chart in the case where the connection apparatus 5 shown in FIG. 4 is connected to a finisher 2 and a saddle device 3.

FIG. 11 is a timing chart in the case where the connection apparatus 5 shown in FIG. 4 is connected to the finisher 2 and the saddle device 3. In FIG. 11, (a) represents an output of the inlet paper sensor 531, (b) represents an output of the outlet paper sensor 532, (c) represents an output of the wired OR circuit 603, (d) represents the speed of a conveying motor 52 in the finisher 2 and the connection apparatus 5 shown in FIG. 4, and (e) represents the speed of the conveying motor in the saddle device 3.

When the output of the wired OR circuit 603 changes from "on" to "off", the connection apparatus 5 changes the paper conveying speed to convey sheets of paper to the saddle device 3 which is a second post-processing apparatus. Specifically, the saddle device 3 accelerates the conveying motor of the saddle device 3 at time t2 when the outlet paper sensor is "off". That is, the saddle device 3 increases the paper conveying speed.

Figure 12:
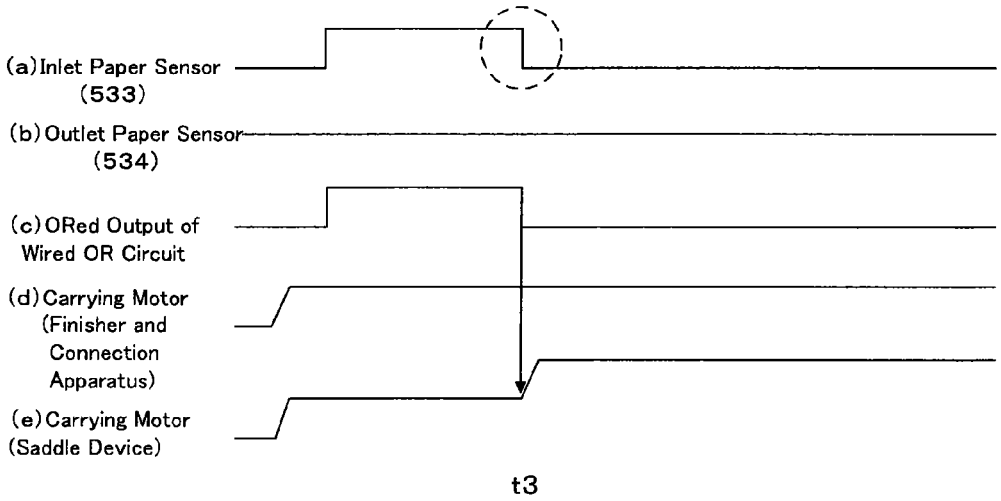
FIG. 12 is a timing chart in the case where the connection apparatus 5A shown in FIG. 5 is connected to a finisher 2 and a saddle device 3.

FIG. 12 is a timing chart in the case where the connection apparatus 5A shown in FIG. 5 is connected to the finisher 2 and the saddle device 3. In FIG. 12, (a) represents an output of the inlet paper sensor 533, (b) represents an output of the outlet paper sensor 534, (c) represents an output of the wired OR circuit 603, (d) represents a speed of a conveying motor in the finisher 2 and the connection apparatus 5A shown in FIG. 5, and (e) represents a speed of the conveying motor of the saddle device 3.

The saddle device 3 accelerates the conveying motor of the saddle device 3 at time t3 when the inlet paper sensor is "off". That is, the saddle device 3 increases the paper conveying speed.

As described above, the connection apparatus 5 according to the embodiment has the flapper portion 51 for switching the first sheet conveying path to the second sheet conveying path and vice versa, and the input paper sensor 531 or 533 and the outlet paper sensor 532 or 534 which are connected to the wired OR circuit. For this reason, there are effects that the connection apparatus 5 can distribute sheets of paper with images formed thereon to a plurality of different sheet post-processing apparatuses, and that the connection apparatus 5 can deliver the sheets of paper to the post-processing apparatuses in paper discharge timing which can be controlled appropriately.

(Paper Guide Opening and Closing Mechanism of Connection Apparatus)

Figure 13A:
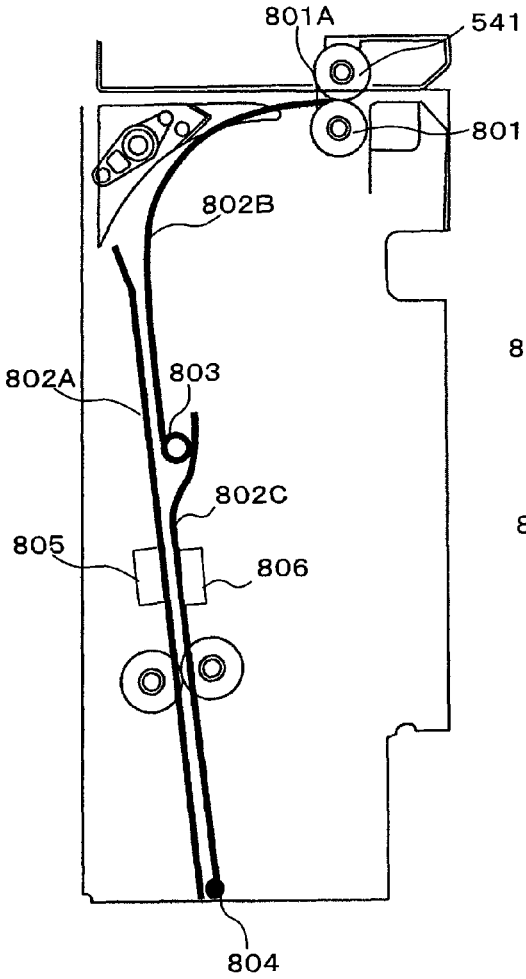
FIG. 13A is a view showing a state in which paper guides of the connection apparatus 5 are closed.
Figure 13B:
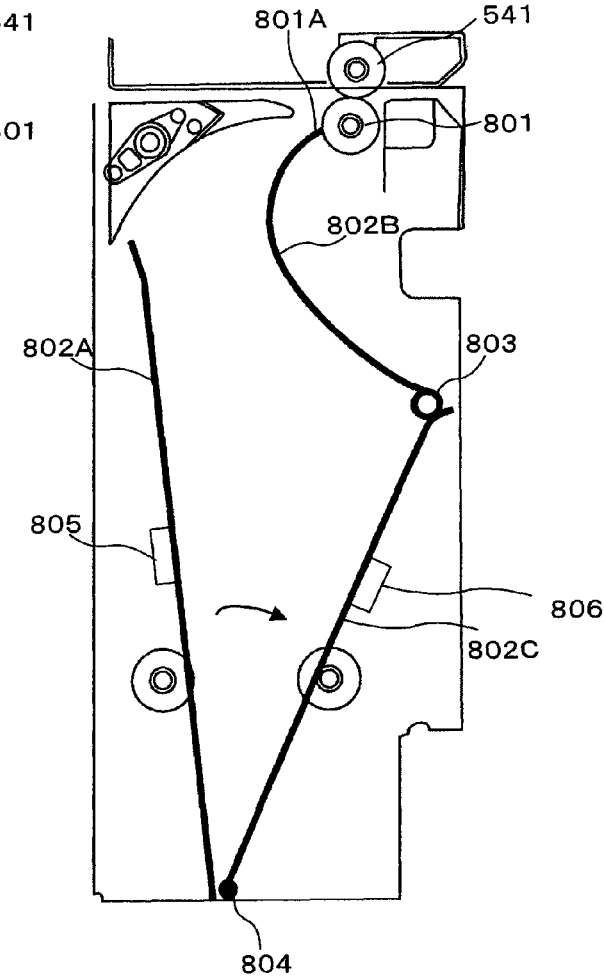
FIG. 13B is a view showing a state in which the paper guides of the connection apparatus 5 are opened.

Further, a paper guide opening and closing mechanism of the connection apparatus 5 will be described. FIG. 13A is a view showing a state in which paper guides of the connection apparatus 5 are closed. FIG. 13B is a view showing a state in which the paper guides of the connection apparatus 5 are opened.

As shown in FIGS. 13A and 13B, the connection apparatus 5 has a first paper guide 802A, a second paper guide 802B, and a third paper guide 802C.

The first paper guide 802A is provided with a magnet 805 on its rear surface and fixed to a housing.

The second paper guide 802B has one end connected to a roller shaft 801 of one of the pair of inlet rollers 541 by a first connection point 801A so that the second paper guide 802B can be rotated.

The third paper guide 802C has one end connected to the other end of the second paper guide 802B by a second connection point 803 and the other end connected to the housing by a fulcrum 804 so that the third paper guide 802C can be rotated.

The fulcrum 804 is disposed in such a position that the second paper guide 802B and the third paper guide 802C can be balanced with each other at a point on the way to transition from a close state to an open state.

An operation knob 806 for opening and closing rotation is provided on a front side of the third paper guide 802C. The third paper guide 802C is opened in accordance with the opening rotation of the operation knob 806. When the third paper guide 802C is opened, the second paper guide 802B is opened following the third paper guide 802C. When the third paper guide 802C is closed, the second paper guide 802B is closed following the third paper guide 802C and the magnet 805 is biased by magnetic force.

In addition, configuration may be made so that a grip portion is provided in an end portion of one of the roller shafts 801, and that a driving or driven roller of the inlet rollers 541 is rotated while interlocked with the grip portion. Since such configuration permits the third paper guide 802C and the second paper guide 802B to be interlocked with the opening rotation of the knob 806 performed for the purpose of paper removal, handling property is improved.

In addition, as shown in FIG. 5, a guide opening and closing mechanism for the sheet conveying path is provided in the connection apparatus 5A similarly.

The connection apparatus 5A includes a first paper guide 502A, a second paper guide 502B and a third paper guide 502C. The first paper guide 502A is provided with a magnet 505 on its rear surface and fixed to a housing. The second paper guide 502B has one end connected to a roller shaft 501 of one of the pair of the inlet rollers 543 so that the second paper guide 502B can be rotated. The third paper guide 502C has one end connected to the other end of the second paper guide 502B by a second connection point 503 and the other end connected to the housing by a fulcrum 504 so that the third paper guide 502C can be rotated. The fulcrum 504 is disposed in such a position that the second paper guide 502B and the third paper guide 502C are balanced with each other at a point on the way to transition from a close state to an open state. An operation knob 506 for opening and closing rotation is provided in a front side of the second paper guide 502B. The second paper guide 502B is opened in accordance with the opening rotation of the operation knob 506. When the second paper guide 502B is opened, the third paper guide 502C is opened following the second paper guide 502B. When the second paper guide 502B is closed, the third paper guide 502C is closed following the second paper guide 502B, and the magnet 505 is biased by magnetic force. Since such configuration permits the second paper guide 502B and the third paper guide 502C to be interlocked with each other, handling property is improved. In addition, similar handling property can be achieved by provision of an operation knob on the third paper guide 502C. Since such configuration permits the second paper guide 502B and the third paper guide 502C to be interlocked with the opening rotation of the knob 506 performed for the purpose of paper removal, handling property is improved.

Further, configuration may be made so that a grip portion is provided in an end portion of one of the roller shafts 501, and that a driving or driven roller of the inlet rollers 543 is rotated while interlocked with the grip portion in order to remove paper.

As described above, the connection apparatus 5 or 5A according to the embodiment has: the first paper guide 802A or 502A fixed to the housing and provided with the magnet; and the third paper guide 802C or 502C having one end connected to the second paper guide 802B or 502B by the second connection point 803 or 503 and the other end connected to the housing by the fulcrum 804 or 504 so that the third paper guide 802C or 502C can be rotated. For this reason, each paper guide can be opened without increase in size of the connection apparatus 5, so that there is an effect that a sufficient operating space can be secured for jam release.

(Flexible Paper Guide for Improving Accuracy of Paper Sensor)

The temperature of each sheet of paper with an image formed thereon, discharged from the image forming apparatus 1, is very high. For this reason, the following disadvantage may occur in the sheet post-processing apparatus or the connection apparatus 5 connected to the image forming apparatus 1.

Figure 14A:
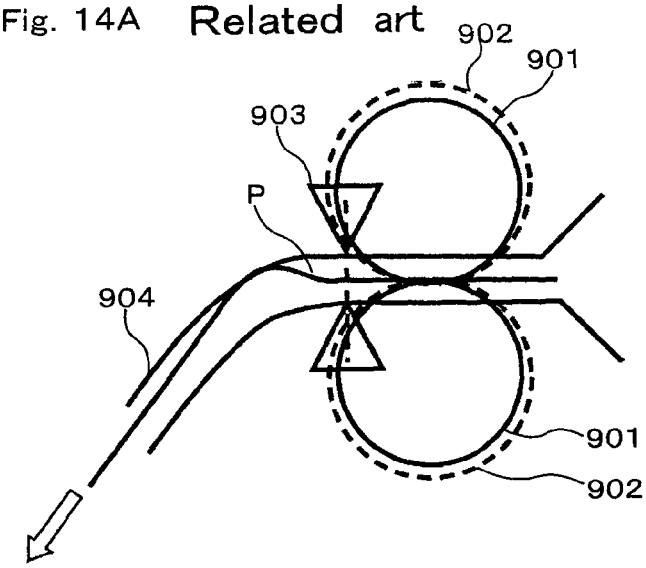
Fig. 14A Related art
FIG. 14A is a side view of the vicinity of inlet rollers 901 in the related art.

FIG. 14A is a side view of the vicinity of inlet rollers 901 in the related art. Since the temperature of each sheet of paper P with an image formed thereon, discharged from the image forming apparatus 1, is high, the inlet rollers 901 are thermally expanded so that the diameter of each inlet roller 901 is enlarged as designated by a dotted line 902.

In this condition, the quantity of paper carried by the inlet rollers 901 becomes larger than the quantity of paper carried by the paper conveying rollers on the downstream side, so that the sheet of paper P is bent like a mountain in a paper guide 904.

Figure 14B:
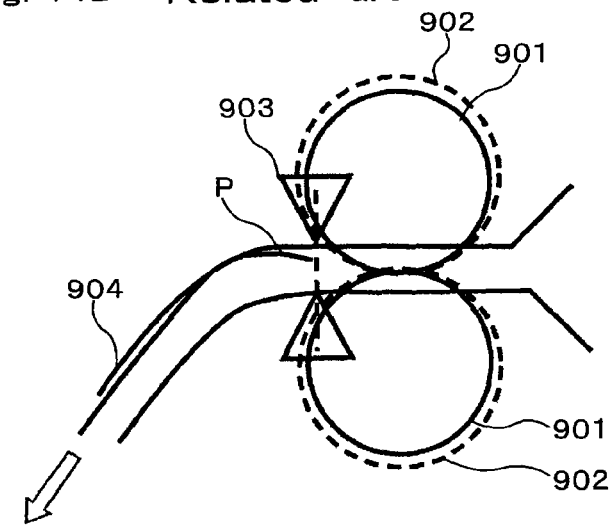
Fig. 14B Related art
FIG. 14B is a view of the related art showing a state just after a sheet of paper has been passed between the inlet rollers 901.

FIG. 14B is a view showing a state of the related art just after a sheet of paper has passed between the inlet rollers 901. A transmission type sensor 903 detects that a sheet of paper has passed once.

Figure 14C:
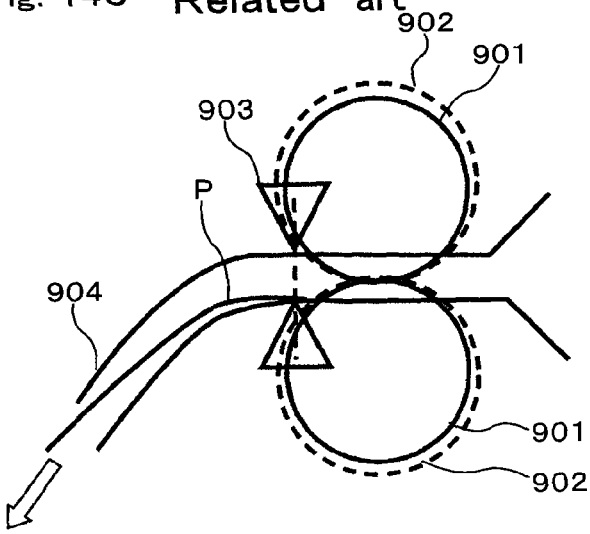
Fig. 14C Related art
FIG. 14C is a view of the related art showing a state in which a transmission type sensor 903 detects the sheet of paper again.

FIG. 14C is a view showing a state of the related art in which the transmission type sensor 903 detects the sheet of paper again. When the sheet of paper P is unbent as shown in FIG. 14C, the rear end of the sheet of paper P is detected again by the transmission type sensor 903. In such a case, there was a problem that the sheet post-processing apparatus or the connection apparatus 5 might recognize by mistake that a next sheet of paper had been carried.

In this embodiment, the sheet post-processing apparatus or the connection apparatus 5 has a flexible paper guide 910 which is provided in the position of the inlet rollers 901 as an inlet of the sheet conveying path so that the flexible paper guide 910 has a length ranging from an upstream side of the transmission type sensor 903 to a downstream side of the transmission type sensor 903 with respect to the conveying path and in which a portion corresponding to the transmission type sensor 903 is cut off.

Figure 15:
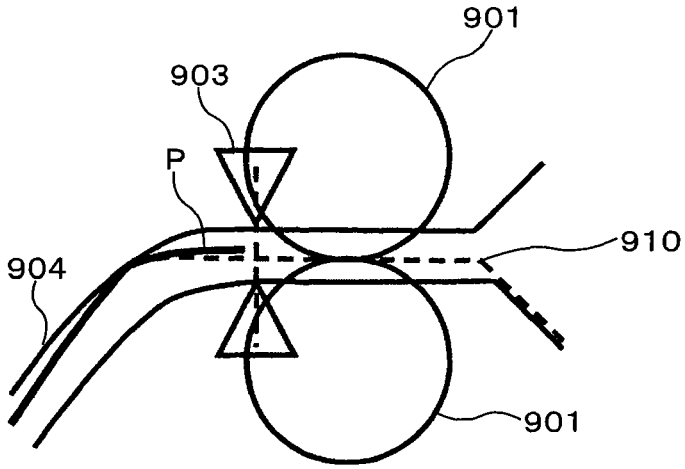
FIG. 15 is a side view of a flexible paper guide 910.

FIG. 15 is a side view of the flexible paper guide 910. In FIG. 15, the flexible paper guide 910 is designated by a dotted line. As shown in FIG. 15, the flexible paper guide 910 biases a sheet of paper toward one side of a paper path formed by the paper guide 904 so that the sheet of paper can be suppressed from fluttering. Thus, the rear end of the sheet of paper P is prevented from being detected by the transmission type sensor 903 again.

Figure 16:
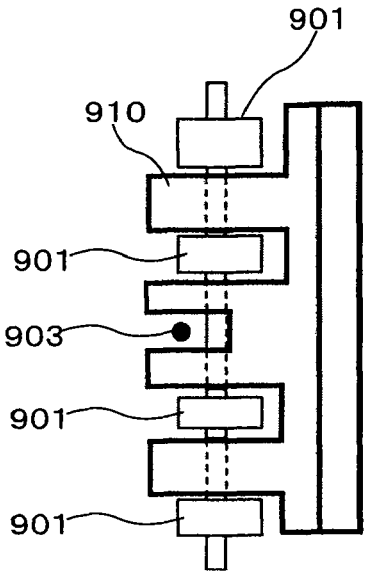
FIG. 16 is a top view of the flexible paper guide 910.

FIG. 16 is a top view of the flexible paper guide 910. As shown in FIG. 16, the flexible paper guide 910 has a cut-off portion corresponding to the transmission type sensor 903 and cut-off portions corresponding to the inlet rollers 901. Thus, the flexible paper guide 910 is prevented from disturbing the transmission type sensor 903 and the inlet rollers 901.

As described above, in this embodiment, the sheet post-processing apparatus or the connection apparatus 5 has the flexible paper guide 910 provided in the inlet rollers 901. Thus, there is an effect that the transmission type sensor 903 can be prevented from detecting the rear end of a sheet of paper P by mistake.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A connection apparatus comprising:

inlet rollers for accepting a sheet of paper with an image formed thereon from an image forming apparatus;

an inlet paper sensor provided close to a nip portion between the inlet rollers with respect to a paper conveying direction of the inlet rollers;

a flapper portion provided on a downstream side of the inlet rollers and the inlet paper sensor with respect to the paper conveying direction and for switching a first sheet conveying path for conveying the sheet of paper to a first sheet post-processing apparatus to a second sheet conveying path for conveying the sheet of paper to a second sheet post-processing apparatus, and vice versa, the second sheet conveying path having a paper conveying distance longer than that of the first sheet conveying path;

outlet rollers provided on the second sheet conveying path and on a downstream side of the flapper portion with respect to the paper conveying direction;

an outlet paper sensor provided on a downstream side of the outlet rollers with respect to the paper conveying direction;

a driving source configured to drive a conveying member for conveying the sheet of paper to one of the first and second sheet conveying paths; and an OR circuit to receive an output of the inlet paper sensor and an output of the outlet paper sensor as inputs and configured for outputting an ORed value of these outputs.

2. A connection apparatus according to claim 1, further comprising:

a driving means for accelerating the paper conveying speed of the conveying means for conveying a sheet of paper to the second sheet post-processing apparatus, when the output of the OR circuit changes from "on" to "off".

3. A connection apparatus according to claim 1, wherein:

the spacing distance between the inlet paper sensor and the outlet paper sensor is smaller than the paper conveying direction length of a minimum-size sheet of paper allowed to be processed by the second sheet post-processing apparatus provided to be connected to the second sheet conveying path.

4. A connection apparatus according to claim 1, wherein:

the driving means carries the sheet of paper to the second sheet conveying path which is located below the inlet rollers and the first sheet conveying path.

5. A connection apparatus according to claim 1, wherein:

the driving means carries the sheet of paper to the first sheet conveying path which is located above the inlet rollers and the second sheet conveying path.

6. A connection apparatus according to claim 1, wherein:

mounting brackets are provided in a surface for accepting a sheet of paper with an image formed thereon and a surface connected to the sheet post-processing apparatus, respectively, so that the connection apparatus is connected to the image forming apparatus and the sheet post-processing apparatus;

the mounting brackets include:

mounting brackets of a third sheet post-processing apparatus which can be mounted between the image forming apparatus and the connection apparatus; and mounting brackets of the connection apparatus which are the same in shape as those of the mounting brackets of the third sheet post-processing apparatus.

7. A connection apparatus according to claim 6, wherein:

the fulcrum is disposed in such a position that the second paper guide and the third paper guide are balanced with each other at a point on the way to transition from a close state to an open state.

8. A connection apparatus according to claim 1, further comprising a first, second and third paper guides provided in the second sheet conveying path, wherein:

the first paper guide is fixed to a housing;

the second paper guide has one end connected to a roller shaft and the other end connected to a third paper guide so that the second paper guide can be rotated; and the third paper guide has one end connected to the second paper guide and the other end connected to the housing by a fulcrum so that the third paper guide can be rotated.

9. A connection apparatus according to claim 1, further comprising:

a paper guide which is provided in a detection position of the inlet sensor in an inlet of the sheet conveying path and has a length ranging from an upstream side of a transmission type sensor to a downstream side of the transmission type sensor with respect to the sheet conveying path and in which a portion corresponding to the transmission type sensor is cut off, wherein:

the paper guide biases the sheet of paper toward one side of a paper path.

10. A connection apparatus according to claim 9, wherein:

the paper guide is made of a flexible material.

11. A paper conveying method using a connection apparatus, comprising:

accepting a sheet of paper with an image formed thereon from an image forming apparatus by inlet rollers;

detecting the sheet of paper by an inlet paper sensor provided close to a nip portion between the inlet rollers;

switching a first sheet conveying path for conveying the sheet of paper to a first sheet post-processing apparatus to a second sheet conveying path for conveying the sheet of paper to a second sheet post-processing apparatus, and vice versa, by a flapper portion provided on a downstream side of the inlet paper sensor with respect to the paper conveying direction, the second sheet conveying path having a paper conveying distance longer than that of the first sheet conveying path;

discharging the sheet of paper by outlet rollers provided on the second sheet conveying path and on a downstream side of the flapper portion with respect to the paper conveying direction;

detecting the sheet of paper by an outlet paper sensor provided on a downstream side of the outlet rollers with respect to the paper conveying direction;

delivering the sheet of paper to a plurality of sheet post-processing apparatuses on a downstream side with respect to the paper conveying direction; and receiving an output of the inlet paper sensor and an output of the outlet paper sensor as inputs and outputting an ORed value of these outputs from an OR circuit provided in the connection apparatus.

12. A paper conveying method using a connection apparatus according to claim 11, further comprising:

accelerating the speed of a sheet of paper carried to the second sheet post-processing apparatus, when the output of the OR circuit changes from "on" to "off".

13. A paper conveying method using a connection apparatus according to claim 11, further comprising:

driving a drive motor provided in the connection apparatus to convey the sheet of paper to the second sheet conveying path located below the inlet rollers.

14. A paper conveying method using a connection apparatus according to claim 11, further comprising:

driving a drive motor provided in the connection apparatus to convey the sheet of paper to the first sheet conveying path located above the inlet rollers.

15. A paper conveying method using a connection apparatus according to claim 11, further comprising:

detecting a rear end of a sheet of paper while urging the sheet of paper toward one side of a paper path by a paper guide which is provided in a detection position of the inlet sensor in an inlet of the sheet conveying path and has a length ranging from an upstream side of a transmission type sensor to a downstream side of the transmission type sensor with respect to the sheet conveying path and in which a portion corresponding to the transmission type sensor is cut off.

16. A paper conveying method using a connection apparatus according to claim 11, wherein further comprising:

conveying the sheet with a first paper guide, a second paper guide and a third paper guide wherein the first paper guide is fixed to a housing;

the second paper guide has one end connected to a roller shaft and the other end connected to the third paper guide so that the second paper guide can be rotated; and the third paper guide has one end connected to the second paper guide and the other end connected to the housing by a fulcrum so that the third paper guide can be rotated.

17. A paper conveying method using a connection apparatus according to claim 11, wherein further comprising:

conveying the sheet with a first paper guide, a second paper guide and a third paper guide, wherein the first paper guide is fixed to a housing;

the second paper guide has one end connected to a roller shaft and the other end connected to the third paper guide so that the second paper guide can be rotated; and the third paper guide has one end connected to the second paper guide and the other end connected to the housing by a fulcrum so that the third paper guide can be rotated, wherein the fulcrum is set in such a position that the second paper guide and the third paper guide are balanced with each other at a point on the way to transition from a close state to an open state.

* * * * *